US005700617A

United States Patent [19]

Takiguchi et al.

[11] Patent Number: 5,700,617

[45] Date of Patent: Dec. 23, 1997

[54] TONER FOR DEVELOPING ELECTROSTATIC IMAGES AND CHARGE-CONTROLLING AGENT

[75] Inventors: Tsuyoshi Takiguchi, Kawasaki; Kenji Okado, Yokohama; Masaaki Taya, Kawasaki; Ryoichi Fujita, Tokyo; Makoto Kanbayashi, Kawasaki; Wakashi Iida, Higashikurume; Tetsuya Ida, Kawasaki, all of Japan

[73] Assignee: Canon Kabushiki Kaisha, Tokyo, Japan

[21] Appl. No.: 727,219

[22] Filed: Oct. 8, 1996

[30] Foreign Application Priority Data

Oct. 12, 1995 [JP] Japan ..... 7-289228

[51] Int. Cl.[6] ..... G03G 9/097; H01B 1/00; H01B 1/06

[52] U.S. Cl. ..... 430/110; 252/500; 252/518

[58] Field of Search ..... 430/110; 252/500, 252/518

[56] References Cited

U.S. PATENT DOCUMENTS

| | | | |
|---|---|---|---|
| 2,297,691 | 10/1942 | Carlson | 430/31 |
| 3,666,363 | 5/1972 | Tanaka et al. | 430/55 |
| 4,071,361 | 1/1978 | Marushima | 430/55 |
| 4,206,064 | 6/1980 | Kiuchi et al. | 430/106 |
| 5,346,795 | 9/1994 | Pickering et al. | 430/110 |
| 5,385,798 | 1/1995 | Law et al. | 430/110 |
| 5,563,015 | 10/1996 | Bonsignore et al. | 430/106 |
| 5,571,654 | 11/1996 | Ong | 430/110 |

FOREIGN PATENT DOCUMENTS

| | | |
|---|---|---|
| 0488743 | 6/1992 | European Pat. Off. . |
| 0490370 | 6/1992 | European Pat. Off. . |
| 0531146 | 9/1992 | European Pat. Off. . |
| 42-23910 | 11/1967 | Japan . |
| 43-24748 | 10/1968 | Japan . |
| 55-42752 | 11/1980 | Japan . |
| 63-2074 | 1/1988 | Japan . |
| 63-33755 | 2/1988 | Japan . |
| 63-208865 | 8/1988 | Japan . |
| 63-237065 | 10/1988 | Japan . |
| 64-10261 | 1/1989 | Japan . |
| 4-83262 | 3/1992 | Japan . |
| 4-347863 | 12/1992 | Japan . |

OTHER PUBLICATIONS

Patent Abstracts of Japan, vol. 7, No. 192 (P–218) (–1337) Aug. 1983 for JP 58–91462.

*Primary Examiner*—Roland Martin

*Attorney, Agent, or Firm*—Fitzpatrick, Cella, Harper & Scinto

[57] ABSTRACT

A toner for developing an electrostatic image is formed from toner particles containing a binder resin, a colorant, and a charge-controlling agent. The charge-controlling agent comprises an aromatic oxycarboxylic acid, a metal compound of the aromatic oxycarboxylic acid, and an inorganic compound formed from an inorganic anion and an inorganic cation. The aromatic oxycarboxylic acid, the metal compound of the aromatic carboxylic acid and the inorganic anion are contained in proportions of A (wt. %), B (wt. %) and C (ppm), respectively, satisfying the following conditions: $1/99 \leqq A/B \leqq 20/80$, and $10^2 \leqq C$. Because of the inclusion of an inorganic compound providing a sufficient amount of inorganic anion, the charge-controlling agent shows a stable charge-controlling characteristic, and the resultant toner exhibits a stable developing performance and transferability in continuous image formation in various environmental conditions.

43 Claims, 2 Drawing Sheets

TONER FOR DEVELOPING ELECTROSTATIC IMAGES AND CHARGE-CONTROLLING AGENT

FIELD OF THE INVENTION AND RELATED ART

The present invention relates to a toner for developing electrostatic images in image forming methods, such as electrophotography and electrostatic recording, and a charge-controlling agent for such a toner.

Hitherto, various methods based on electrophotography have been proposed, e.g., in U.S. Pat. Nos. 2,297,691; 3,666,363 (corr. to Japanese Patent Publication (JP-B) 42-23910); and U.S. Pat. No. 4,071,361 (corr. to JP-B 43-24748).

Developing methods for developing electrostatic images include dry-process developing methods and wet-process developing methods. The former further includes a method using a two-component type developer and a method using a mono-component type developer.

In the dry developing methods, there has been used a toner comprising fine toner particles formed by dispersing a dye or a pigment in a natural or synthetic resin. The toner particles may comprise finely pulverized particles on the order of 1–30 μm comprising a colorant or a magnetic material dispersed in a binder resin, such as a styrene copolymer. A magnetic toner may contain magnetic particles of, e.g., magnetite. In a two-component type developer, a toner may ordinarily be blended with carrier particles of, e.g., iron powder or magnetic ferrite particles.

A toner is caused to have a positive or negative charge depending on the polarity of an electrostatic image to be developed therewith.

A toner can be charged by utilizing a triboelectric chargeability of a resin as a toner component, but the toner chargeability in this case is generally low, thus being liable to provide unclear developed images accompanied with fog. In order to provide a desired triboelectric chargeability to a toner, it has been frequently practiced to add to the toner a dye and/or a pigment, and further a charge-controlling agent, for imparting a chargeability.

The charge-controlling agents include a positive charge-controlling agent, examples of which may include: nigrosine dyes, azine dyes, copper phthalocyanine pigments, quaternary ammonium salts, and polymers having a quaternary ammonium salt as a side chain group; and also a negative charge-controlling agent, examples of which may include: metal complex salts of monoazo dyes; metal complexes or metal salts of salicylic acid, naphthoic acid, dicarboxylic acids and derivatives of these; and resins having an acidic group.

Among the above, charge-controlling agents, which are colorless, white or pale-colored, are useful for constituting color toners.

Examples of such charge-controlling agents having also a negative chargeability may include those obtained from aromatic carboxylic acid derivatives. Thus, proposals have been made regarding the use of toner containing an aromatic carboxylic acid derivative or a metal compound of aromatic carboxylic acid derivative. For example, U.S. Pat. No. 4,206,064 (corr. to JP-B 55-42752) has proposed salicylic acid metal compounds and alkylsalicylic acid metal compounds. Japanese Laid-Open Patent Application (JP-A) 63-2074, JP-A 63-33755 and JP-A 4-83262 have proposed salicylic acid-based zinc compounds. JP-A 63-208865, JP-A 63-237065 and JP-A 64-10261 have proposed salicylic acid-based aluminum compounds. JP-A 4-347863 has proposed a toner containing a mixture of a polycyclic aromatic hydroxycarboxylic acid and an aromatic hydroxycarboxylic acid metal compound. U.S. Pat. No. 5,346,795 has proposed a toner containing a salicylic acid-based compound and a salicylic acid-based aluminum compound in a weight ratio of 1/4–4/1 (i.e., 20:80 to 80:20).

However, the toners disclosed in these references do not contain an inorganic compound formed of an inorganic anion and an inorganic cation in addition to the aromatic oxycarboxylic acid, so that it has been difficult to provide a high successive image forming performance, a high developing performance and a high transferability, in combination, by using these toners.

A non-magnetic color toner is frequently blended with magnetic carrier particles to be used as a two-component type developer. In this instance, the developer is generally supplied to a developer-carrying member surface, carried thereon under the action of a magnetic force exerted by a magnet contained inside the developer-carrying member surface and then conveyed to an electrostatic image-bearing member surface to develop an electrostatic image on the electrostatic image-bearing member surface with the toner in the developer.

A resultant toner image is transferred onto a transfer-receiving material for recording (generally, paper) to be fixed thereon under application of energy, such as heat and/or pressure. During the developing and transfer processes, the toner carried electrostatically is moved from the carrier particles to the electrostatic image-bearing member or from the electrostatic image-bearing member to the transfer-receiving material under the action of an electrostatic force in opposite directions.

In this way, the toner movement during the developing and transfer is initiated by peeling caused by overcoming a constraint of Coulomb's force exerted by the carrier particles or the electrostatic image-bearing member. At the time of peeling, it is preferred that the charge of the toner particle surfaces is re-combined to be extinguished to some extent with the charge of opposite polarity of the carrier particles or the electrostatic image-bearing member surface, thus reducing the Coulomb's attraction force in view of the energy for peeling.

More specifically, by promoting the recombination of charges of opposite polarities, the developing and transferring performances of the toner can be remarkably improved to result in images with high image density and image quality of highlight portions.

However, easy recombination of opposite polarity charges can lead to a lowering in triboelectric charge during the blending of the toner and the carrier, so that it is liable to cause the occurrence of fog and toner scattering during a continuous image formation operation.

In view of the above-mentioned problems, it has been desired to provide a charge-controlling agent capable of providing a toner with an improved flowability, suppressed lowering in charging speed in a low-humidity environment and chargeability in a high-humidity environment, and also a reduction in peeling energy due to recombination of charges.

SUMMARY OF THE INVENTION

A principal object of the present invention is to provide a charge-controlling agent and a toner for developing electrostatic images capable of solving the above-mentioned problems.

A more specific object of the present invention is to provide a charge-controlling agent capable of providing a toner showing a high charging speed in a low-humidity environment and retaining a high triboelectric chargeability in a high-humidity environment, and also a toner for developing electrostatic images causing little fog and showing good continuous image forming characteristic by using the charge-controlling agent.

Another object of the present invention is to provide a toner for developing electrostatic images showing a high powder flowability and capable of providing high-quality images.

Another object of the present invention is to provide a charge-controlling agent capable of providing a toner which is easily peelable from the carrier or the electrostatic image-bearing member while retaining a high triboelectric charge, and also for developing electrostatic images capable of realizing high image density and high transferability by containing such a charge-controlling agent.

According to the present invention, there is provided a toner for developing an electrostatic image, comprising toner particles containing a binder resin, a colorant, and a charge-controlling agent;

wherein the charge-controlling agent comprises an aromatic oxycarboxylic acid, a metal compound of the aromatic oxycarboxylic acid, and an inorganic compound formed from an inorganic anion and an inorganic cation, and the aromatic oxycarboxylic acid, the metal compound of the aromatic carboxylic acid and the inorganic anion are contained in proportions of A (wt. %), B (wt. %) and C (ppm), respectively, satisfying the following conditions:

$$1/99 \leq A/B \leq 20/80,$$

and $$10^2 \leq C.$$

According to another aspect of the present invention, there is provided a charge-controlling agent, comprising an aromatic oxycarboxylic acid, a metal compound of the aromatic oxycarboxylic acid, and an inorganic compound formed from an inorganic anion and an inorganic cation, wherein the aromatic oxycarboxylic acid, the metal compound of the aromatic carboxylic acid and the inorganic anion are contained in proportions of A (wt. %), B (wt. %) and C (ppm), respectively, satisfying the following conditions:

$$1/99 \leq A/B \leq 20/80,$$

and $$10^2 \leq C.$$

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
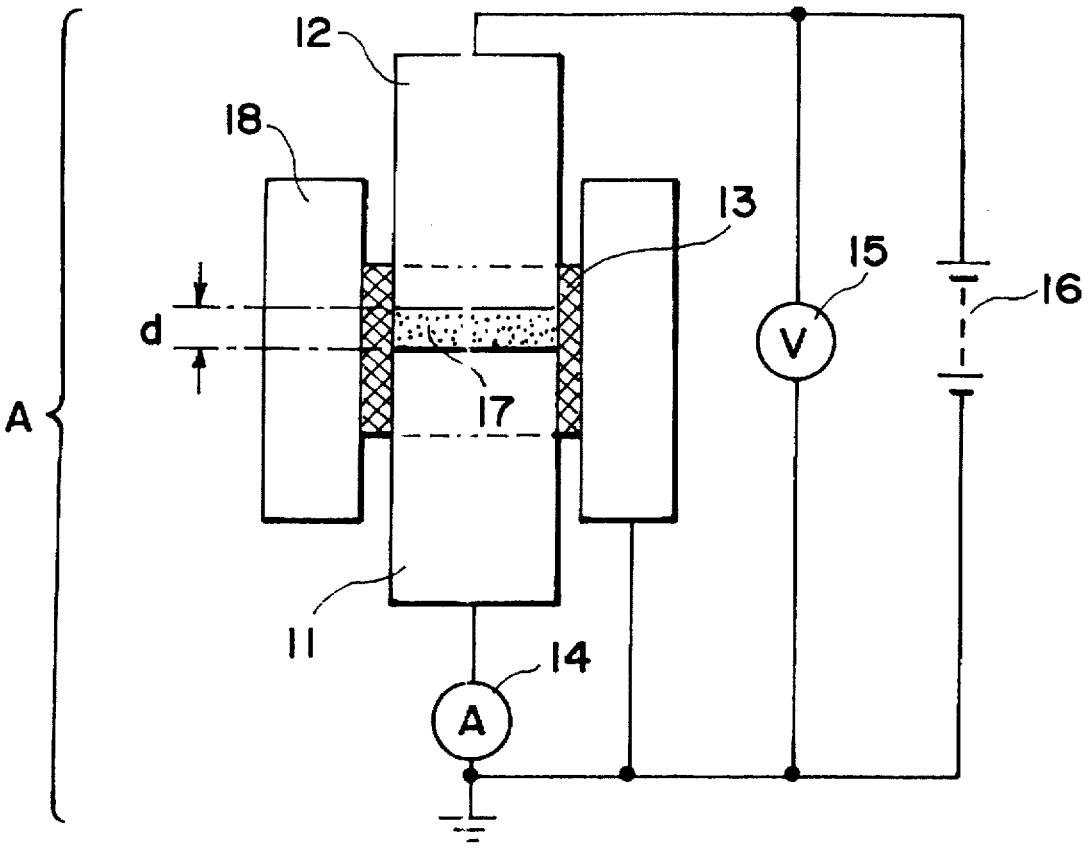
FIG. 1 is an illustration of an apparatus for measuring the volume resistivity of a powdery material, such as a charge-controlling agent.

Herein, a metal compound of an aromatic oxycarboxylic acid refers to a compound having a bond between an oxygen atom of carboxyl group in the aromatic oxycarboxylic acid and a metal. The bond refers to a chemical bond, such as an ionic bond, a covalent bond or a coordinate bond. It is possible that the aromatic oxycarboxylic acid has a further bond with the metal at a part other than the carboxyl group.

A toner containing a metal compound of an organic acid as a charge-controlling agent may have a relatively high triboelectric chargeability in some cases but is generally liable to show a lowering in triboelectric chargeability in a high-humidity environment. On the other hand, in a low-humidity environment, the toner is liable to show a lower charging speed.

This may be attributable to moisture adsorption and desorption near the metal atom such that the moisture adsorption to the metal compound is increased to result in a lower triboelectric charge in a high-humidity environment but is decreased to provide a higher resistivity and a lower charging speed in a low-humidity environment.

According to our study, it has been found possible to suppress the lowering in triboelectric chargeability in a high-humidity environment and the lowering in charging speed in a low-humidity environment by incorporating a specific proportion of an aromatic oxycarboxylic acid in addition to the metal compound of the aromatic oxycarboxylic acid.

The mechanism of the improvement has not been fully clarified as yet, but the specific proportion of the aromatic oxycarboxylic acid may be assumed to block or control the moisture adsorption onto the metal compound.

The addition effect of the aromatic oxycarboxylic acid is however little unless the aromatic oxycarboxylic acid is identical in species to the aromatic hydroxycarboxylic acid constituting the metal compound. This may be attributable to the stability of the metal compound associated with the acid strength and symmetry of the aromatic oxycarboxylic acid.

Herein, the term "aromatic oxycarboxylic acid" is used to refer to a substituted or unsubstituted aromatic hydroxycarboxylic acid and a substituted or unsubstituted aromatic alkoxycarboxylic acid (preferably having 1–6 carbon atoms in the alkoxy group). Such an aromatic oxycarboxylic acid can provide a higher chargeability to the resultant charge-controlling agent presumably because of an effect of a substituent bonded to an aromatic ring through the oxygen atom for lowering the negative charge density on the oxygen atom in the carboxyl group.

The aromatic oxycarboxylic acid may be substituted with one or more groups. Preferred examples of such substituted aromatic oxycarboxylic acid may include monoalkyl- or dialkyl-aromatic oxycarboxylic acids having preferably 1–12 carbon atoms in each alkyl group because of a high chargeability even in a high-humidity environment. This may be attributable to a small negative charge density of carboxyl group oxygen due to a resonance structure of the monoalkyl- or dialkyl-aromatic oxycarboxylic acid, a three-dimensionally large structure of the co-present monoalkyl- or dialkyl-substituted aromatic oxycarboxylic acid functioning to block water molecules.

Preferred examples of the aromatic hydroxycarboxylic acid may include salicylic acid, and hydroxynaphthoic acid each preferably having one or two alkyl groups. Preferred species of the aromatic hydroxycarboxylic acid may include salicylic acid, alkylsalicylic acid, dialkylsalicylic acid, hydroxynaphthoic acid and alkylhydroxynaphthoic acid. 3,5-Di-tert-butylsalicylic acid and 5-tert-octylsalicylic acid are particularly preferred as the aromatic hydroxycarboxylic acid. Preferred examples of the aromatic alkoxycarboxylic acid may be obtained by substituting an alkoxy group for the hydroxy group in the above compounds.

The valence and ionic radius of metal in the metal compound is correlated with the strength of bond with the aromatic oxycarbolxylic acid, and a higher metal valence and a smaller ionic radius lead to a stronger bond with the aromatic oxycarboxylic acid, thus providing a metal compound of which the bond is less liable to be broken during production or long use of the toner and which is more stably fixed in the toner particles.

According to our study, the metal constituting the metal compound may preferably have a valence of two or more and an ionic radius of at most 0.8 Å (with reference to values listed in Table 15.23 at page 718 of "Kagaku Binran (Chemical Handbook) Revised Third Edition" edited by the Chemical Society of Japan). Preferred examples of the metal include aluminum, chromium and zinc, among which aluminum is particularly preferred.

The charge-controlling agent may preferably contain the aromatic oxycarboxylic acid and the aromatic oxycarboxylic acid metal compound in amounts of A (wt. %) and B (wt. %) satisfying:

$$1/99 \leqq A/B \leqq 20/80,$$

more preferably $$1/99 \leqq A/B \leqq 15/85,$$

further preferably $$1/99 \leqq A/B \leqq 10/90.$$

In case of A/B<1/99, the amount of the aromatic oxycarboxylic acid blocking the metal compound from moisture is scarce, so that the chargeability in a high-humidity environment is liable to be lowered. On the other hand, in case of 20/80<A/B, the metal compound is completely covered with the aromatic oxycarboxylic acid, so that the charging speed in a low-humidity environment is liable to be lowered and toner scattering is liable to be caused to fail in keeping high image qualities during a long period of use.

Further, excessive blockage of the metal compound functioning as a charging site with the aromatic oxycarboxylic acid hinders the recombination of charges at the time of peeling, thus resulting in lower developing performance and transferability of the toner, as may be presumed from increases in contact resistivity between the metal compound and the carrier or the electrostatic image-bearing member.

As a result of further study, based on a concept of functional separation that the chargeability is controlled by electron mobility and the re-combination of charges is controlled by ionic mobility, we have arrived at the use of a charge-controlling agent containing an inorganic compound providing inorganic anions and inorganic cations in addition to the aromatic oxycarbolxylic acid and the aromatic oxycarboxylic acid metal compound in a toner. As a result, it has become possible to realize remarkable improvements in developing performance and transferability of the toner while maintaining the chargeability of the toner in both low-humidity and high-humidity environments.

In case where the charge recombination is effected ionically, it is generally considered that ions of the same polarity as the toner charge are caused to move from inside to outside the toner particles, so that anions contained in the anionically chargeable charge-controlling agent of the present invention may move from inside to outside the toner particles. As a result of our study, in case where the anions are those of an organic compound, the improvement in developing performance or transferability has not been substantially attained.

This may be presumably attributable to such a mechanism that organic anions, unlike inorganic anions, form bonds like conjugated ones showing only a small polarization and provide ion pairs close as a whole to neutrality, so that only a weak electrostatic attraction force is applied from positive charges on the carrier particles or the electrostatic image-bearing member surface, and the movement of anions cannot be readily caused. The anions may preferably be sulfate ions or halogen ions.

On the other hand, it has been also found that the improvement in developing performance or transferability is not substantially attained if cations of the inorganic compound contained in the charge-controlling agent are organic cations. This again may be attributable to a mechanism that organic cations provide ion pairs showing only a weak polarization like the use of organic anions so that the movement of anions cannot be readily caused.

The cations of the inorganic compound contained in the charge-controlling agent of the present invention may preferably have a fewer valence and a smaller ionic radius. This may be presumably because a smaller valence of cation provides a weaker bond with anion so that the movement of an anion alone at the time of development or transfer is less hindered thereby, and a smaller radius of ion becomes a harden ion to provide a larger polarization between the anion and the cation, thus causing a stronger electrostatic attraction force exerted by the positive charge on the carrier particles and the electrostatic image-bearing member surface, whereby the movement of anions from the inside to the outside of the toner particles is promoted to facilitate the recombination of charges.

According to our study, it has been found that alkali metal ions are particularly preferred as the inorganic cations. This is presumably because the alkali metal ions best satisfy the above-mentioned preferred properties of the cations.

The anions and cations of the inorganic compound may preferably be contained in C (ppm) and D (ppm) on a weight basis in the charge-controlling agent according to the present invention satisfying: $10^2 \leqq C$, more preferably $2\times10^2 \leqq C$, and $3\times10^2 \leqq C+D$.

If $C \geqq 10^2$ the recombination of charges can be smoothly proceeded to provide improved developing performance and transferability. If $C+D \geqq 3\times10^2$, a sufficient degree of charge recombination is caused to provide an improved charging speed in a low-humidity environment, effective prevention of fog and toner scattering and an improved continuous image formation performance of the toner. The upper limits of C and D are not so strict. However, it is preferred to satisfy $2\times10^2 \leqq C \leqq 7\times10^3$, more preferably $3\times10^3 \leqq C \leqq 6\times10^3$, and $1\times10^2 \leqq D \leqq 4\times10^4$, more preferably $2\times10^2 \leqq D \leqq 3\times10^4$.

According to our study, it has been also found the resistivity of the charge-controlling agent also remarkably affect the developing performance and transferability of the resultant toner. The resistivity of the charge-controlling agent directly indicates the mobility of ions contained in the charge-controlling agent, and a smaller resistivity is assumed to promote the charge recombination. In fact, according to our study, a charge-controlling agent having a volume resistivity of at most $9.5\times10^8$ ohm.cm (as measured according a method described hereinafter) provided good results in both developing performance and transferability. The volume resistivity of the charge-controlling agent may be varied by appropriate control of species and amounts of the inorganic anions and cations constituting the inorganic compound so as to provide a volume of at most $9.5\times10^8$ ohm.cm. The volume resistivity may more preferably be in the range of $1\times10^6$–$9.4\times10^8$ ohm.cm.

The charge-controlling agent may preferably be added in an amount of 0.5–15 wt. parts per 100 wt. parts of the binder resin constituting the toner. Below 0.5 wt. part, the above-mentioned effects can be exhibited only in a low degree. On the other hand, in excess of 15 wt. parts, the deterioration of carrier performance due to deposition of the toner (spent toner accumulation) is liable to occur, thus leading to occurrence of fog and toner scattering due to a lowering in chargeability during continuous image formation. An amount of 1–10 wt. parts is further preferred.

The charge-controlling agent according to the present invention may be produced through a diversity of methods, such as a method of adding an aromatic oxycarboxylic acid and an anion and a cation for constituting the inorganic compound to a metal compound of the aromatic oxycarboxylic acid after preparation of the metal compound through a known process, or a one-step method or process of effecting appropriate pH control, etc., during a process for synthesis of the aromatic oxycarboxylic acid metal compound.

The toner according to the present invention can contain a known charge-controlling agent in addition to the charge-controlling agent of the present invention. The charge-controlling agent may be internally or externally added to toner particles, but the internal addition within toner particles is preferred.

The binder resin for the toner of the present invention may for example comprise: homopolymers of styrene and derivatives thereof, such as polystyrene, poly-p-chlorostyrene and polyvinyltoluene; styrene copolymers such as styrene-p-chlorostyrene copolymer, styrene-vinyltoluene copolymer, styrene-vinylnaphthalene copolymer, styrene-acrylate copolymer, styrene-methacrylate copolymer, styrene-methyl α-chloromethacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer and styrene-acrylonitrile-indene copolymer; polyvinyl chloride, phenolic resin, natural resin-modified phenolic resin, natural resin-modified maleic acid resin, acrylresin, acrylic resin, methacrylic resin, polyvinyl acetate, silicone resin, polyester resin, polyurethane, polyamide resin, furan resin, epoxy resin, xylene resin, polyvinyl butyral, terpene resin, chmarone-indene resin and petroleum resin. Among these, styrene copolymer, polyester resin and epoxy resin are preferred in order to provide a negatively chargeable toner.

A crosslinked styrene copolymer and a crosslinked polyester resin are also preferred binder resins.

Examples of the comonomer constituting such a styrene copolymer together with styrene monomer may include other vinyl monomers inclusive of: monocarboxylic acids having a double bond and derivative thereof, such as acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile, and acrylamide; dicarboxylic acids having a double bond and derivatives thereof, such as maleic acid, butyl maleate, methyl maleate and dimethyl maleate; vinyl esters, such as vinyl chloride, vinyl acetate, and vinyl benzoate; ethylenic olefins, such as ethylene, propylene and butylene; vinyl ketones, such as vinyl methyl ketone and vinyl hexyl ketone; and vinyl ethers, such as vinyl methyl ether, vinyl ethyl ether, and vinyl isobutyl ether. These vinyl monomers may be used alone or in mixture of two or more species in combination with the styrene monomer.

The crosslinking agent may principally be a compound having two or more double bonds susceptible of polymerization, examples of which may include: aromatic divinyl compounds, such as divinylbenzene, and divinylnaphthalene; carboxylic acid esters having two double bonds, such as ethylene glycol diacrylate, ethylene glycol dimethacrylate and 1,3-butanediol dimethacrylate; divinyl compounds, such as divinylaniline, divinyl ether, divinyl sulfide and divinylsulfone; and compounds having three or more vinyl groups. These may be used singly or in mixture.

A binder resin principally comprising a styrene-acryl copolymer (i.e., a copolymer of styrene with an acrylic monomer, such as (meth)acrylate or (meth)acrylic acid) may preferably be one including a THF (tetrahydrofuran)-soluble content providing a molecular weight distribution by GPC (gel permeation chromatography) showing at least one peak (preferably a main peak) in a molecular weight region of $3\times10^3$–$5\times10^4$ and at least one peak in a molecular weight region of at least $10^5$ and containing 50–90 wt. % of a component having a molecular weight of at most $10^5$.

A binder resin principally comprising a polyester resin may preferably have such a molecular weight distribution that it shows at least one peak in a molecular weight region of $3\times10^3$–$5\times10^4$ and contains 60–100 wt. % of a component having a molecular weight of at most $10^5$. It is further preferred to have at least one peak within a molecular weight region of $5\times10^3$–$2\times10^4$.

A polyester resin is excellent in fixability and is suitable for provide a color toner. It is particularly preferred to use a polyester resin obtained by subjecting a diol principally comprising a bisphenol derivative represented by the following formula or a substitution derivative thereof:

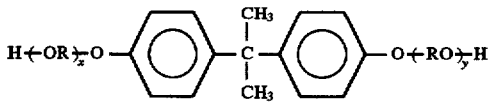

(wherein R denotes an ethylene or propylene group, x and y are independently a positive integer of at least 1 with the proviso that the average of x+y is in the range of 2–10); with a carboxylic acid component comprising a carboxylic acid having two or more functional groups (carboxylic groups), its anhydride or a lower alkyl ester thereof (e.g., fumaric acid, maleic acid, maleic anhydride, phthalic acid, terephthalic acid, trimellitic acid, pyromellitic acid) because of a good chargeability characteristic.

It is possible to provide a magnetic toner by incorporating a magnetic material as the colorant. The magnetic material may preferably be in the form of fine powder having an average particle size (diameter) of 0.05–0.5 μm, more preferably 0.1–0.4 μm. The magnetic fine powder may preferably have a coefficient of variation in particle size of at most 30%. The magnetic fine powder may preferably be contained in an amount of 40–120 wt. parts per 100 wt. parts of the binder for constituting a magnetic toner.

The magnetic material may for example comprise: iron oxides, such as magnetite, γ-iron oxide, ferrite and excessive iron-type ferrite; metals, such as iron, cobalt and nickel, and alloys of these metals with a metal, such as aluminum, cobalt, copper, lead, magnesium, tin, zinc, antimony, beryllium, bismuth, cadmium, calcium, manganese, selenium, titanium, tungsten, or vanadium; and mixtures of the above.

The toner particles can contain wax.

The wax used in the present invention may include hydrocarbon wax, examples of which may include: alkylene polymer obtained by radical polymerization of alkylene under a high pressure; alkylene polymer obtained by polymerization under a low pressure by using a Ziegler catalyst; alkylene polymer obtained by thermal decomposition of high-molecular weight alkylene polymer; and synthetic hyrocarbons obtained by hydrogenating distillation residue of hydrocarbons obtained from synthesis gas containing carbon monoxide and hydrogen through the Arge process. It is particularly preferred to use a hydrocarbon wax obtained by fractionating the above-mentioned hydrocarbon waxes into a particular fraction, e.g., by the press sweating method, the solvent method, the vacuum distillation and fractionating crystallization, for removing a low-molecular weight fraction or for collecting a low-molecular weight fraction.

Other types of waxes may include microcrystalline wax, carnauba wax, sasol wax, paraffin wax and ester wax.

The wax may preferably have a number-average molecular weight (Mn) of 500–1200 and a weight-average molecular weight (Mw) of 800–3600 when measured as equivalent to polyethylene. When the molecular weight is below the above-mentioned range, the resultant toner is caused to have inferior anti-blocking characteristic and developing performance. Above the above-mentioned molecular weight range, it becomes difficult to obtain a toner showing good fixability and anti-offset characteristic.

The wax may preferably have an Mw/Mn ratio of at most 5.0, more preferably at most 3.0.

The wax may effectively be contained in an amount of 0.5–10 wt. parts per 100 wt. parts of the binder resin.

The colorants may include known chromatic and black to white pigments. Among these, an organic pigment having a high lipophilicity may be preferred.

Examples thereof may include: Naphthol Yellow S, Hansa Yellow G, Permanent Yellow NCG, Permanent Orange GTR, Pyrazolone Orange, Benzidine Orange G, Permanent Red 4R, Watching Red calcium salt, Brilliant Carmine 38, Fast Violet B, Methyl Violet Lake, Phthalocyanine Blue, Fast Sky Blue and Indanthrene Blue BC.

It is preferred to use pigments, e.g., of the polycondensed azo type, insoluble azo type, quinacridone type, isoindolinone type, perylene type, anthraquinone type and copper phthalocyanine type, because of high light-resistance.

More specifically, magenta pigments may include: C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207, 209, 238; C.I. Pigment Violet 19; C.I. Vat Red 1, 2, 10, 13, 15, 23, 29, 35.

Cyan pigments may include C.I. Pigment Blue 2, 3, 15, 16, 17; C.I. Vat Blue 6; C.I. Acid Blue 45; and copper phthalocyanine pigments represented by the following formula (1) and having a phthalocyanine skeleton and 1–5 phthalimide methyl groups as substituents:

(1)

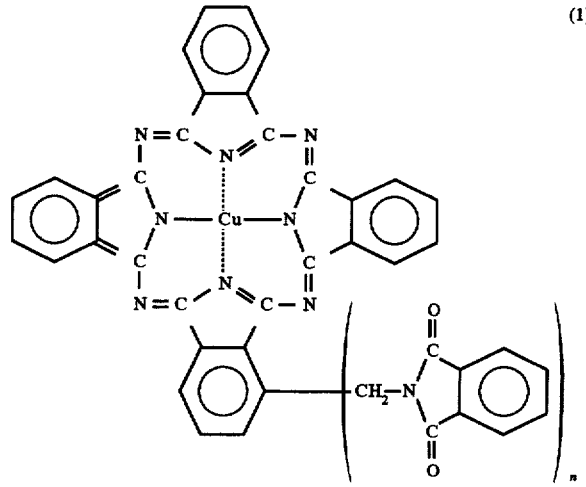

n = 1~5

Yellow pigments may include; C.I. Pigment Yellow 1, 2, 3, 4, 5, 6, 7, 10, 11, 12, 13, 14, 15, 16, 17, 23, 65, 73, 74, 81, 83, 93, 94, 95, 97, 98, 109, 120, 128, 138, 147, 151, 154, 166, 167, 173, 180, 181: C.I. Vat Yellow 1, 3, 20.

In the present invention, it is preferred to use a pigment in the form of a paste as produced from a known wet pigment production process, i.e., obtained without any drying step from a slurry before a filtration step in the production process. In other words, it is not preferred to use a pasty pigment obtained by wetting with water a once-dried powdery pigment.

The content of such an organic pigment may be at most 12 wt. parts, preferably 0.5–7 wt. parts per 100 wt. parts of the binder resin, for a yellow toner which sensitively affect the transparency of an OHP (overhead projector) film. In excess of 12 wt. %, the reproducibility of green or red as a mixture color of yellow, or the color of human skin occurring in images, can be lowered.

An organic colorant may preferably be contained in an amount of at most 15 wt. parts, more preferably 0.1–9 wt. parts, per 100 wt. parts of the binder resin for a magenta or a cyan color toner.

The toner particles thus prepared according to the present invention may have a good flowability as they are, but can be blended further with a flowability improving agent.

The flowability improving agent may comprise any substance, preferably a powdery substance, capable of providing the toner with increased flowability by the addition thereof. Examples thereof may include: hydrophobic colloidal silica fine powder, colloidal silica fine powder, hydrophobic titanium oxide fine powder, titanium oxide fine powder, hydrophobic alumina fine powder, alumina fine powder, and powdery mixtures of the above.

Toner particles according to the present invention may be produced through a process wherein component materials as described above are well-kneaded by a hot kneading means, such as hot rollers, a kneader and an extruder, followed by mechanical pulverization and classification of the kneaded product; a process wherein the materials, such as the colorant and the charge-controlling agent are dispersed in a binder resin solution, and the resultant dispersion is dried by spraying; a polymerization toner production process wherein the component materials are dispersed in a monomer for providing the binder resin to provide a polymerizable mixture, which is then emulsified or suspended in an aqueous medium and polymerized therein to provide toner particles.

The toner according to the present invention can be blended with carrier particles to provide a two-component type developer. In this instance, it is possible to surface-coat the carrier particles with various materials, particularly resin. In this case, the species and the amount of the coating resin may be appropriately selected depending on the required charging performance, resistivity and surface unevenness of the carrier.

Examples of the coating resin may include: styrene-acrylate copolymer, styrene-methacrylate copolymer, other acrylate copolymers and methacrylate copolymers, modified or unmodified silicone resin, fluorine-containing resin, polyamide resin, ionomer resin, polyphenylene sulfide resin and mixtures of these resins.

The carrier core may comprise or magnetic oxide, such as ferrite, excessive iron-type ferrite, magnetite or γ-iron oxide.

A two-component type developer may be obtained by blending the toner according to the present invention and a carrier so as to provide a toner concentration of 1–15 wt. %, preferably 2–13 wt. %, in the developer so as to provide generally good results. If the toner concentration is below 1 wt. %, the image density is liable to be low. In excess of 15 wt. %, fog and toner scattering in an image forming machine are liable to be caused.

Hereinbelow, some methods for measuring properties characterizing the products of the present invention and methods for evaluation thereof will be described.

(1) Volume resistivity

The volume resistivity of a charge-controlling agent was measured by using a measurement cell A as shown in FIG. 1. Referring to FIG. 1, the cell A includes a lower electrode 11 and an upper electrode 12 respectively having a contact area S with a sample 17 of 2 $cm^2$. In an environment of 23° C. and 65% RH, a powdery sample is placed between the electrodes 11 and 12 within a cylindrical insulating resin 13 held along a guide ring 18 so as to provide a thickness d of 1 mm under a load of 15 kg from the upper electrode 12. In this state, an AC voltage of 5000 volts (10000 Hz) is applied across the sample 17 from a constant voltage supply 15 disposed in parallel with a capacitor 17 to read a current passing through the sample 17 by an ammeter 14. From the measured current, the volume resistivity of the sample 17 is calculated in an ordinary manner.

(2) Triboelectric charge (TC [mC/kg])

Figure 2:
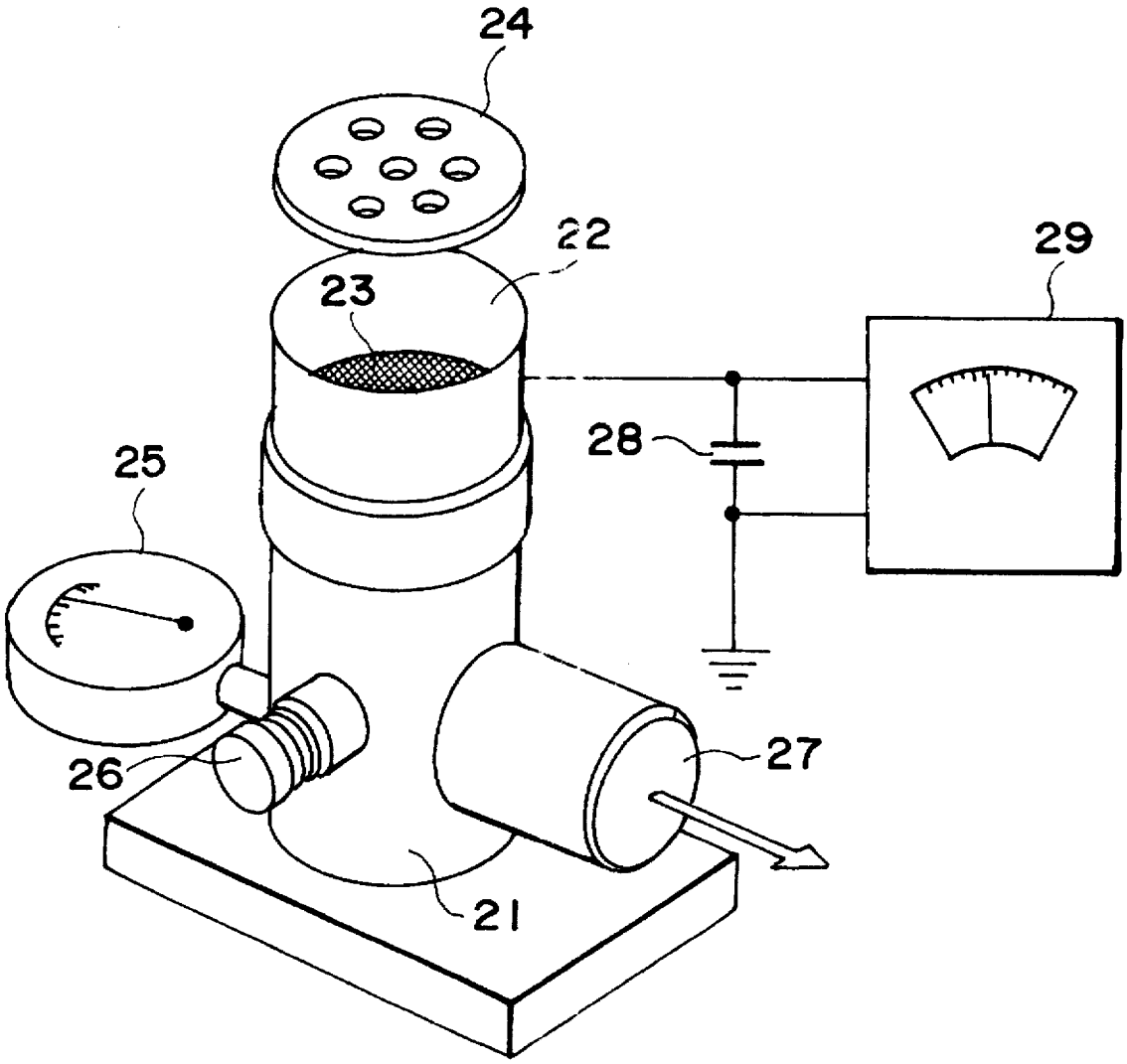
FIG. 2 is an illustration of an apparatus for measuring the triboelectric chargeability of a toner.

An apparatus as shown in FIG. 2 was used for measuring a triboelectric charge of toner samples.

Referring to FIG. 2, ca. 0.5–0.9 g of a developer taken from the surface of a sleeve in a developing device is placed in a metal measurement vessel 22 equipped with a 50 mesh-screen 23 at its bottom, and the vessel is covered with a metal lid 24. The total weight ($W_1$ g) of the measurement vessel at this time is measured. Then, an aspirator 21 (of which the portion contacting the vessel 22 is insulating) is operated by sucking through a suction outlet 27 while adjusting an air control valve 26 to provide a pressure of 250 mmAq at a vacuum gauge 25. In this state, the aspiration is sufficiently performed, preferably about 2 min., to remove the toner by sucking. The potential on a potential meter 29 connected to the vessel 22 via a capacitor 28 (having a capacitance C μF) is read at V volts. The total weight ($W_2$ g) after the aspiration is measured, and the triboelectric charge of the toner is calculated according to the following equation:

$$\text{Triboelectric charge } (mC/kg) = C \times V/(W_1 - W_2).$$

(3) Analysis of aromatic oxycarboxylic acid and inorganic anions and cations

The contents of an aromatic oxycarboxylic acid, an inorganic cation and an inorganic anion in a charge-controlling agent were measured in the following manner.

For measurement of an aromatic oxycarboxylic acid content, a weighed amount of a charge-controlling agent is dissolved in chloroform and, into the resultant solution, acetonitrile is added to precipitate an aromatic oxycarboxylic acid metal compound. The resultant liquid is subjected to filtration to be separated into a precipitate and a filtrate. A prescribed amount of n-tridecane as an internal standard is added to the filtrate, and the resultant solution is subjected to gas chromatography to measure the content of the aromatic oxycarboxylic acid in comparison with the content of the n-tridecane.

For the measurement of inorganic cation and anion constituting an inorganic compound in a charge-controlling agent, a weighed amount of charge-controlling agent is dissolved or swollen with methanol, and water is added to the methanol liquid. The resultant methanol-water mixture liquid is boiled under heating and then filtrated. The resultant filtrate is subjected to ICP (inductively coupled plasma) emission electroscopy to measure the content of the inorganic cation, and another portion of the filtrate is subjected to ion chromatography to measure the content of the inorganic anion.

Hereinbelow, the present invention will be described more specifically based on Examples which however should not be construed to limit the scope of the present invention. In the following Examples, "part(s)" and "ppm" used to describe compositions are all by weight unless otherwise noted specifically.

Production Example 1 for Al Compound

Aqueous solution of 0.5 mol of NaOH and 0.4 mol of 3,5-di-tert-butylsalicylic acid were mixed and heated for dissolution. The resultant solution was added to aqueous solution of 0.1 mol of $Al_2(SO_4)_3$, and the mixture was stirred under heating. The liquid was then neutralized and filtrated to recover a white precipitate, which was then washed with water and dried to obtain 3,5-di-tert-butylsalicylic acid aluminum compound (Al Compound 1).

The resultant Al Compound 1 was found to contain substantially no 3,5-di-tert-butylsalicylic acid, but contain 40 ppm of sodium ions and 70 ppm of sulfate ions.

Production Example for Cr Compound

Cr Compound was prepared in a similar manner as in Production Example 1 above except for using $Cr_2(SO_4)_3$ instead of $Al_2(SO_4)$.

The resultant Cr Compound was found to contain substantially no free 3,5-di-tert-butylsalicylic acid but contain 30 ppm of sodium ions and 70 ppm of sulfate ions.

Production Example for Zn Compound

Zn Compound was prepared in a similar manner as in Production Example 1 above except for using $ZnCl_2$ instead of $Al_2(SO_4)$.

The resultant Zn Compound was found to contain substantially no free 3,5-di-tert-butylsalicylic acid but contain 20 ppm of sodium ions and 46 ppm of chloride ions.

Production Example 2 for Al Compound

Al Compound 2 was prepared in a similar manner as in Production Example 1 above except for using 5-tert-octylsalicylic acid instead of 3,5-di-tert-butylsalicylic acid.

The resultant Al Compound 2 was found to contain substantially no free 5-tert-ethylsalicylic acid but contain 30 ppm of sodium ions and 70 ppm of sulfate ions.

Production Example 1 for Charge Controller Composition

Into a methanol/water (=70/30) mixture solution containing 3,5-di-tert-butylsalicylic acid and sodium sulfate ($Na_2SO_4$) dissolved therein, Al Compound 1 was dispersed, and the resultant dispersion was dried by spray-drying to obtain Charge Controller Composition 1, which was found to contain 240 ppm of sodium ions and 560 ppm of sulfate ions.

The composition of Charge Controller Composition 1 is shown in Table 1 appearing hereinafter together with those of other Charge Controller Compositions prepared in manners described below.

Production Examples 2–4 for Charge Controller Composition

Charge Controller Compositions 2–4 were prepared in similar manners as in Production Example 1 except for using different amounts of 3,5-di-tert-butylsalicylic acid and sodium sulfate.

Production Example 5 for Charge Controller Composition

Charge Controller Composition 5 was prepared in a similar manner as in Production Example 1 except for using Cr Compound instead of Al Compound 1 together with different amounts of 3,5-di-tert-butylsalicylic acid and sodium sulfate.

Production Example 6 for Charge Controller Composition

Charge Controller Composition 6 was prepared in a similar manner as in Production Example 1 except for using Zn Compound instead of Al Compound 1 together with different amounts of 3,5-di-tert-butylsalicylic acid and sodium sulfate.

Production Example 7 for Charge Controller Composition

Charge Controller Composition 5 was prepared in a similar manner as in Production Example 1 except for using Al Compound 2 and 5-tert-octylsalicylic acid instead of Al Compound 1 and 3,5-di-tert-butylsalicylic acid respectively, together with a different amount of sodium sulfate.

Production Example 8 for Charge Controller Composition

Charge Controller Composition 8 was prepared in a similar manner as in Production Example 1 except for using different amounts of 3,5-di-tert-butylsalicylic acid and sodium sulfate.

Production Example 9 for Charge Controller Composition

Charge Controller Composition 9 was prepared in a similar manner as in Production Example 1 except for using potassium sulfate instead of sodium sulfate together with a different amount of 3,5-di-tertbutylsalicylic acid.

Production Example 10 for Charge Controller Composition

Charge Controller Composition 10 was prepared in a similar manner as in Production Example 1 except for using calcium sulfate instead of sodium sulfate together with a different amount of 3,5-di-tert-butylsalicylic acid.

Production Example 11 for Charge Controller Composition

Charge Controller Composition 11 was prepared in a similar manner as in Production Example 1 except for using potassium chloride instead of sodium sulfate together with a different amount of 3,5-di-tert-butylsalicylic acid.

Production Example 12 for Charge Controller Composition (Comparative)

Charge Controller Composition 5 was prepared in a similar manner as in Production Example 1 except for using tetra-n-butylammonium chloride instead of sodium sulfate.

Production Example 13 for Charge Controller Composition (Comparative)

Charge Controller Composition 13 was prepared in a similar manner as in Production Example 1 except for using sodium p-toluenesulfonate instead of sodium sulfate.

Production Example 14 for Charge Controller Composition (Comparative)

Charge Controller Composition 14 was prepared in a similar manner as in Example 1 except for using Al Compound 1 after further washing well with hot water to reduce the sodium and sulfate ions and using no additional sodium sulfate.

Production Example 15 for Charge Controller Composition (Comparative)

Charge Controller Composition 15 was prepared in a similar manner as in Example 1 except for using Al Compound 1 after further washing well with hot water to reduce the sodium and sulfate ions, using no additional sodium sulfate and using a different amount of 3,5-di-tert-butylsalicylic acid.

Production Example 16 for Charge Controller Composition (Comparative)

Charge Controller Composition 16 was prepared in a similar manner as in Production Example 1 except for using different amounts of 3,5-di-tert-butylsalicylic acid and sodium sulfate.

Production Example 17 for Charge Controller Composition (Comparative)

Charge Controller Composition 17 was prepared in a similar manner as in Production Example 1 except for using Al Compound 2 instead of Al Compound 1 together with a different amount of sodium sulfate.

Production Example 18 for Charge Controller CompositiOn (Comparative)

Charge Controller Composition 18 was prepared in a similar manner as in Production Example 1 except for using 5-tert-octylsalicylic acid instead of 3,5-di-tert-butylsalicylic acid together with a different amount of sodium sulfate.

TABLE 1

| Charge controller | Metal component* | Oxycarboxylic* acid | A (wt. %)/B (wt. %) | Cation (D) | | Anion (C) | | V.R.*4 (ohm · cm) |
|---|---|---|---|---|---|---|---|---|
| 1 | DTBSA.Al | DTBSA | 6.4/93.6 | $Na^+$, | 240 ppm | $SO_4^{2-}$, | 560 ppm | $9.2 \times 10^8$ |
| 2 | DTBSA.Al | DTBSA | 6.7/93.3 | $Na^+$, | 460 ppm | $SO_4^{2-}$, | 1210 ppm | $9.1 \times 10^8$ |
| 3 | DTBSA.Al | DTBSA | 7.2/92.8 | $Na^+$, | 370 ppm | $SO_4^{2-}$, | 740 ppm | $9.1 \times 10^8$ |
| 4 | DTBSA.Al | DTBSA | 1.1/98.9 | $Na^+$, | 410 ppm | $SO_4^{2-}$, | 820 ppm | $9.1 \times 10^8$ |
| 5 | DTBSA.Cr | DTBSA | 5.9/94.1 | $Na^+$, | 210 ppm | $SO_4^{2-}$, | 490 ppm | $9.1 \times 10^8$ |
| 6 | DTBSA.Zn | DTBSA | 6.8/93.2 | $Na^+$, | 220 ppm | $Cl^-$, | 510 ppm | $9.1 \times 10^8$ |
| 7 | 5TOSA.Al | 5TOSA | 1.5/98.5 | $Na^+$, | 230 ppm | $SO_4^{2-}$, | 530 ppm | $9.1 \times 10^8$ |
| 8 | DTBSA.Al | DTBSA | 13.9/86.1 | $Na^+$, | 220 ppm | $SO_4^{2-}$, | 530 ppm | $9.3 \times 10^8$ |
| 9 | DTBSA.Al | DTBSA | 7.2/92.8 | $Na^+$, | 40 ppm | $SO_4^{2-}$, | 370 ppm | $9.2 \times 10^8$ |
| | | | | $K^+$, | 260 ppm | | | |
| 10 | DTBSA.Al | DTBSA | 7.2/92.8 | $Na^+$, | 40 ppm | $SO_4^{2-}$, | 1130 ppm | $9.1 \times 10^8$ |
| | | | | $Ca^2$, | 450 ppm | | | |
| 11 | DTBSA.Al | DTBSA | 7.2/92.8 | $Na^+$, | 40 ppm | $SO_4^{2-}$, | 60 ppm | $9.0 \times 10^8$ |

TABLE 1-continued

| Charge controller | Metal component* | Oxycarboxylic* acid | A (wt. %)/B (wt. %) | Cation (D) | | Anion (C) | | V.R.*4 (ohm · cm) |
|---|---|---|---|---|---|---|---|---|
| | | | | $K^+$, | 380 ppm | $Cl^-$, | 350 ppm | |
| 12 (Comp.) | DTBSA.Al | DTBSA | 6.4/93.6 | $Na^+$, | 40 ppm | $SO_4^{2-}$, | 70 ppm | $9.7 \times 10^8$ |
| | | | | **TBA, | 480 ppm | $Cl^-$, | 70 ppm | |
| 13 (Comp.) | DTBSA.Al | DTBSA | 6.4/93.6 | $Na^+$, | 390 ppm | $SO_4^{2-}$, | 70 ppm | $9.6 \times 10^8$ |
| | | | | | | ***PTS, | 2600 ppm | |
| 14 (Comp.) | DTBSA.Al | DTBSA | 6.4/93.6 | $Na^+$, | 30 ppm | $SO_4^{2-}$, | 60 ppm | $9.8 \times 10^8$ |
| 15 (Comp.) | DTBSA.Cl | DTBSA | 0.7/99.3 | $Na^+$, | 30 ppm | $SO_4^{2-}$, | 60 ppm | $9.6 \times 10^8$ |
| 16 (Comp.) | DTBSA.Cl | DTBSA | 22.6/77.4 | $Na^+$, | 110 ppm | $SO_4^{2-}$, | 240 ppm | $9.4 \times 10^8$ |
| 17 (Comp.) | 5TOSA.Al | DTBSA | 1.5/98.5 | $Na^+$, | 230 ppm | $SO_3^{2-}$, | 530 ppm | $9.2 \times 10^8$ |
| 18 (Comp.) | DTBSA.Al | 5TOSA | 1.5/98.5 | $Na^+$, | 420 ppm | $SO_4^{2-}$, | 850 ppm | $9.1 \times 10^8$ |

*DTBSA: 3,5-di-tert-butylsalicylic acid
5TOSA: 5-tert-octylsalicylic acid
**TBA: tetra-n-butylammonium ion
***PTS: p-toluenesulfonate ion
*4V.R. = volume resistivity

EXAMPLE 1

| | |
|---|---|
| Polyester resin (AV (acid value) = 1.2)** | 100 parts |
| Phthalocyanine pigment | 4 parts |
| Charge Controller Composition 1 | 5 parts |

** A polyester resin prepared by polycondensation of polyoxypropylene (2,2)-2,2-bis(4-hydroxyphenyl)propane with fumaric acid and 1,2,5-hexanetricarboxylic acid.

The above ingredients were subjected to sufficient preliminary blending by a Henschel mixer and melt-kneaded through a twin-screw extrusion kneader, followed by cooling, coarse crushing by a hammer mill into ca. 1–2 mm and fine pulverization by an air jet mill. The resultant fine pulverizate was classified to obtain cyan toner particles having a weight-average particle size ($D_4$) of 5.8 μm.

On the other hand, 100 parts of hydrophilic alumina fine powder was surface-treated with 20 parts of iso-$C_4H_9$—Si $(OCH_3)_3$ to obtain hydrophobic alumina fine powder.

10 wt. parts of the cyan toner particles and 1.5 parts of the hydrophilic alumina fine powder were blended to prepare Cyan Toner 1.

EXAMPLES 2–11 AND COMPARATIVE EXAMPLES 1–7

Cyan Toners 2–18 were prepared respectively in the same manner as in Example 1 except for using Charge Controller Compositions 2–18, respectively, instead of Charge Controller Composition 1.

Image Forming Test 6 parts of Cyan Toner 1 (of Example 1 ) was blended with 94 parts of coated ferrite carrier (average particle size (Dav.)=50 μm) coated with 1.5 wt. % of acryl-modified silicone resin to prepare a two-component type developer.

The two-component type developer was charged in a full-color digital copying machine ("CLC-800", available from Canon K.K.) and used for a mono color-mode continuous image formation while replenishing the toner as necessary and by using an original having an image area occupation ratio of 25 % under different environments of high temperature/high humidity (30° C./80 % RH) and normal temperature/low humidity (25° C./10 % RH). The continuous image formation was performed on 10000 sheets in each of the different environments. The results are inclusively shown in Tables 2-1 to 2-2.

As shown in Tables 2-1 and 2-2, the developer exhibited excellent developing performance and transferability stably in the continuous image formation test while causing little difference in different environments. Further, the developer was free from toner scattering after the 10000 sheets of continuous image formation test.

The same image formation test was performed by using Cyan Toners 2–18 of Examples 2–11 and Comparative Examples 1–7.

TABLE 2-1

| | | 30° C./80% RH | | | | | | | | |
|---|---|---|---|---|---|---|---|---|---|---|
| | | Initial stage | | | | After 10000 sheets | | | | |
| | Toner | I.D. | Quality | TC (nC/kg) | Fog | I.D. | Quality | TC (nC/kg) | Fog | Scatter |
| Ex. | | | | | | | | | | |
| 1 | 1 | 1.71 | A | −27 | 0.4 | 1.72 | A | −26 | 0.5 | A |
| 2 | 2 | 1.70 | A | −27 | 0.4 | 1.71 | A | −26 | 0.5 | A |
| 3 | 3 | 1.71 | A | −26 | 0.4 | 1.72 | A | −25 | 0.5 | A |

TABLE 2-1-continued

| | | 30° C./80% RH | | | | | | | | |
|---|---|---|---|---|---|---|---|---|---|---|
| | | Initial stage | | | | After 10000 sheets | | | | |
| | Toner | I.D. | Quality | TC (nC/kg) | Fog | I.D. | Quality | TC (nC/kg) | Fog | Scatter |
| 4 | 4 | 1.69 | A | −26 | 0.4 | 1.71 | A | −25 | 0.6 | A |
| 5 | 5 | 1.70 | A | −27 | 0.5 | 1.72 | A | −26 | 0.6 | A |
| 6 | 6 | 1.75 | A | −25 | 0.8 | 1.78 | A | −23 | 0.9 | B |
| 7 | 7 | 1.70 | A | −29 | 0.5 | 1.72 | A | −29 | 0.5 | A |
| 8 | 8 | 1.71 | A | −28 | 0.5 | 1.70 | A | −28 | 0.6 | A |
| 9 | 9 | 1.72 | A | −27 | 0.5 | 1.74 | A | −26 | 0.6 | A |
| 10 | 10 | 1.64 | A | −26 | 0.4 | 1.66 | B | −25 | 0.5 | A |
| 11 | 11 | 1.68 | A | −27 | 0.5 | 1.64 | A | −25 | 0.6 | A |
| Comp. Ex. | | | | | | | | | | |
| 1 | 12 | 1.61 | B | −25 | 0.6 | 1.58 | C | −23 | 0.7 | A |
| 2 | 13 | 1.63 | B | −26 | 0.5 | 1.62 | C | −24 | 0.6 | A |
| 3 | 14 | 1.62 | A | −28 | 0.4 | 1.57 | B | −26 | 0.6 | A |
| 4 | 15 | 1.61 | A | −28 | 0.5 | 1.58 | B | −27 | 0.6 | A |
| 5 | 16 | 1.68 | B | −29 | 0.4 | 1.70 | B | −29 | 0.5 | B |
| 6 | 17 | 1.79 | A | −24 | 0.9 | 1.90 | B | −18 | 2.0 | D |
| 7 | 18 | 1.80 | A | −22 | 0.9 | 1.91 | B | −18 | 2.1 | D |

TABLE 2-2

| | | 25° C./10% RH | | | | | | | | |
|---|---|---|---|---|---|---|---|---|---|---|
| | | Initial stage | | | | After 10000 sheets | | | | |
| | Toner | I.D. | Quality | TC (nC/kg) | Fog | I.D. | Quality | TC (nC/kg) | Fog | Scatter |
| Ex. | | | | | | | | | | |
| 1 | 1 | 1.67 | A | −34 | 0.4 | 1.66 | A | −33 | 0.5 | A |
| 2 | 2 | 1.66 | A | −35 | 0.4 | 1.65 | A | −34 | 0.5 | A |
| 3 | 3 | 1.67 | A | −34 | 0.4 | 1.65 | A | −33 | 0.5 | A |
| 4 | 4 | 1.68 | A | −33 | 0.5 | 1.66 | A | −34 | 0.6 | A |
| 5 | 5 | 1.67 | A | −34 | 0.4 | 1.66 | A | −33 | 0.5 | A |
| 6 | 6 | 1.64 | A | −28 | 0.6 | 1.60 | A | −29 | 0.9 | B |
| 7 | 7 | 1.66 | A | −34 | 0.5 | 1.64 | A | −35 | 0.8 | A |
| 8 | 8 | 1.70 | A | −33 | 0.4 | 1.62 | A | −34 | 1.2 | C |
| 9 | 9 | 1.66 | A | −33 | 0.4 | 1.64 | A | −34 | 0.6 | A |
| 10 | 10 | 1.60 | A | −35 | 0.4 | 1.58 | B | −34 | 0.5 | A |
| 11 | 11 | 1.64 | A | −34 | 0.4 | 1.62 | A | −35 | 0.5 | A |
| Comp. Ex. | | | | | | | | | | |
| 1 | 12 | 1.53 | C | −32 | 0.5 | 1.44 | D | −33 | 0.6 | A |
| 2 | 13 | 1.55 | C | −33 | 0.7 | 1.45 | D | −34 | 0.7 | A |
| 3 | 14 | 1.56 | B | −35 | 0.4 | 1.50 | C | −37 | 0.9 | B |
| 4 | 15 | 1.55 | B | −34 | 0.7 | 1.51 | C | −35 | 1.0 | B |
| 5 | 16 | 1.59 | B | −36 | 0.6 | 1.53 | C | −39 | 1.5 | C |
| 6 | 17 | 1.63 | A | −33 | 0.8 | 1.68 | B | −36 | 1.6 | D |
| 7 | 18 | 1.62 | A | −32 | 0.9 | 1.66 | B | −34 | 1.9 | D |

The evaluation results shown in the above Tables 2-1 and 2-2 were obtained according to the methods and standards described below for the respective items except for TC (triboelectric chargeability) for which the measurement method has been already described hereinbefore.

I.D. (Image Density)

The image density of a solid image part (showing a gloss of 25–35 as measured by a gloss meter ("PG-3D", available from Nippon Hasshoku Kogyo K.K.)) was measured by using a Macbeth reflection densitometer available from Macbeth Co.

Quality (Image quality of highlight portion)

Image quality of a highlight portion of an image sample was compared with that of a standard image sample and evaluated at four levels.

A: excellent,

B: good,

C: fair,

D: poor.

The image density (I.D.) and the quality (image quality of highlight portion) were evaluated as measures for the developing performance and transferability of a toner since the former are remarkably affected by the latter properties.

Fog

Fog (%) was evaluated as a difference in reflectance based on reflectance values measured by using "REFLECTOMETER MODEL TC-6DS" (available from Tokyo Denshoku K.K.) together with an accessory amber filter for cyan toner images and calculated according to the following equation. A smaller value represents less fog.

Fog(reflectance)(%)=[reflectance (%) of standard paper]−[reflectance (%) of non-image part of a sample]

Scatter (Toner scattering)

The degree of toner scattering out of the developing device was evaluated around and below the developing device within the copying apparatus by eye observation at four level.

A: No toner scattering out of the developing device at all.

B: A recognizable amount of toner found on members around the developing device.

C: A small amount of toner spilt from the developing device found below the developing device.

D: A large amount of toner spilt from the developing device found below the developing device.

What is claimed is:

1. A toner for developing an electrostatic image, comprising toner particles containing a binder resin, a colorant, and a charge-controlling agent;

wherein the charge-controlling agent comprises an aromatic oxycarboxylic acid, a metal compound of the aromatic oxycarboxylic acid, and an inorganic compound formed from an inorganic anion and an inorganic cation, and the aromatic oxycarboxylic acid, the metal compound of the aromatic carboxylic acid and the inorganic anion are contained in proportions of A (wt. B (wt. %) and C (ppm), respectively, satisfying the following conditions:

$$1/99 \leqq A/B \leqq 20/80,$$

and $$10^2 \leqq C.$$

2. The toner according to claim 1, wherein A (wt. %) and B (wt. %) satisfy the following condition:

$$1/99 \leqq A/B \leqq 15/85.$$

3. The toner according to claim 1, wherein A (wt. %) and B (wt. %) satisfy the following condition:

$$1/99 \leqq A/B \leqq 10/90.$$

4. The toner according to claim 1, wherein the aromatic oxycarboxylic acid, the metal compound of the aromatic oxycarboxylic acid, the inorganic anion and the inorganic cation are contained in proportions of A (wt. %), B (wt. %), C (ppm) and D (ppm), respectively, satisfying the following conditions:

$$1/99 \leqq A/B \leqq 20/80,$$

$$10^2 \leqq C,$$

and $$3\times10^2 \leqq C+D.$$

5. The toner according to claim 4, wherein C (ppm) is at least $2\times10^2$ (ppm).

6. The toner according to claim 4, wherein A (wt. %), B (wt. %) and C (ppm) satisfy the following conditions:

$$1/99 \leqq A/B \leqq 15/85,$$

and $$C \geqq 2\times10^2.$$

7. The toner according to claim 4, wherein A (wt. %), B (wt. %) and C (ppm) satisfy the following conditions:

$$1/99 \leqq A/B \leqq 10/90,$$

and $$C \geqq 2\times10^2.$$

8. The toner according to claim 1, wherein the inorganic cation of the inorganic compound is an alkali metal ion.

9. The toner according to claim 1, wherein the inorganic anion of the inorganic compound is a sulfate ion or a halide ion.

10. The toner according to claim 1, wherein the aromatic oxycarboxylic acid is a substituted aromatic hydroxycarboxylic acid or a substituted aromatic alkoxycarboxylic acid.

11. The toner according to claim 10, wherein the aromatic oxycarboxylic acid has an alkyl group substituent.

12. The toner according to claim 1, wherein the aromatic oxycarboxylic acid is a compound selected from the group consisting of salicylic acid, alkylsalicylic acid, dialkylsalicylic acid, hydroxynaphthoic acid, and alkylhydroxynaphthoic acid.

13. The toner according to claim 1, wherein the aromatic oxycarboxylic acid is 3,5-di-tert-butylsalicylic acid or 5-tert-octylsalicylic acid.

14. The toner according to claim 1, wherein the metal compound of the aromatic oxycarboxylic acid comprises a metal having a valence of at least 2.

15. The toner according to claim 1, wherein the charge-controlling agent comprises di-tert-butylsalicylic acid, di-tert-butylsalicylic acid aluminum compound, sodium ion and sulfate ion.

16. The toner according to claim 1, wherein the charge-controlling agent comprises di-tert-butylsalicylic acid, di-tert-butylsalicylic acid chromium compound, sodium ion and sulfate ion.

17. The toner according to claim 1, wherein the charge-controlling agent comprises di-tert-butylsalicylic acid, di-tert-butylsalicylic acid zinc compound, sodium ion and sulfate ion.

18. The toner according to claim 1, wherein the charge-controlling agent comprises 5-tert-octylsalicylic acid, 5-tert-octylsalicylic acid aluminum compound, sodium ion and sulfate ion.

19. The toner according to claim 1, wherein the binder resin comprises a polymer selected from the group consisting of styrene copolymer, polyester resin and epoxy resin.

20. The toner according to claim 1, wherein the charge-controlling agent is contained in an amount of 0.5–15 wt. parts per 100 wt. parts of the binder resin.

21. The toner according to claim 1, wherein the charge-controlling agent is contained in an amount of 1–10 wt. parts per 100 wt. parts of the binder resin.

22. The toner according to claim 1, wherein the toner particles are negatively chargeable.

23. The toner according to claim 1, wherein the charge-controlling agent has a volume resistivity of at most $9.5\times10^8$ ohm.cm.

24. A charge-controlling agent, comprising an aromatic oxycarboxylic acid, a metal compound of the aromatic oxycarboxylic acid, and an inorganic compound formed from an inorganic anion and an inorganic cation, wherein the aromatic oxycarboxylic acid, the metal compound of the aromatic carboxylic acid and the inorganic anion are contained in proportions of A (wt. B (wt. %) and C (ppm), respectively, satisfying the following conditions:

$$1/99 \leqq A/B \leqq 20/80,$$

and $$10^2 \leqq C.$$

25. The charge-controlling agent according to claim 24, wherein A (wt. %) and B (wt. %) satisfying the following condition:

$$1/99 \leqq A/B \leqq 15/85.$$

26. The charge-controlling agent according to claim 24, wherein A (wt. %) and B (wt. %) satisfying the following condition:

$$1/99 \leqq A/B \leqq 10/90.$$

27. The charge-controlling agent according to claim 24, wherein the aromatic oxycarboxylic acid, the metal compound of the aromatic oxycarboxylic acid, the inorganic anion and the inorganic cation are contained in proportions of A (wt. %), B (wt. %), C (ppm) and D (ppm), respectively, satisfying the following conditions:

$$1/99 \leqq A/B \leqq 20/80,$$

$$10^2 \leqq C,$$

and $$3\times10^2 \leqq C+D.$$

28. The charge-controlling agent according to claim 27, wherein C (ppm) is at least $2\times10^2$ (ppm).

29. The charge-controlling agent according to claim 27, wherein A (wt. %), B (wt. %) and C (ppm) satisfying the following conditions:

$$1/99 \leqq A/B \leqq 15/85,$$

and $$C \geqq 2\times10^2.$$

30. The charge-controlling agent according to claim 27, wherein A (wt. %), B (wt. %) and C (ppm) satisfying the following conditions:

$$1/99 \leqq A/B \leqq 10/90,$$

and $$C \geqq 2\times10^2.$$

31. The charge-controlling agent according to claim 24, wherein the inorganic cation of the inorganic compound is an alkali metal ion.

32. The charge-controlling agent according to claim 24, wherein the inorganic anion of the inorganic compound is a sulfate ion or a halide ion.

33. The charge-controlling agent according to claim 24, wherein the aromatic oxycarboxylic acid is a substituted aromatic hydroxycarboxylic acid or a substituted aromatic alkoxycarboxylic acid.

34. The charge-controlling agent according to claim 33, wherein the aromatic oxycarboxylic acid has an alkyl group substituent.

35. The charge-controlling agent according to claim 24, wherein the aromatic oxycarboxylic acid is a compound selected from the group consisting of salicylic acid, alkylsalicylic acid, dialkylsalicylic acid, hydroxynaphthoic acid, and alkylhydroxynaphthoic acid.

36. The charge-controlling agent according to claim 24, wherein the aromatic oxycarboxylic acid is 3,5-di-tert-butylsalicylic acid or 5-tert-octylsalicylic acid.

37. The charge-controlling agent according to claim 24, wherein the metal compound of the aromatic oxycarboxylic acid comprises a metal having a valence of at least 2.

38. The charge-controlling agent according to claim 24, wherein the charge-controlling agent comprises di-tert-butylsalicylic acid, di-tert-butylsalicylic acid aluminum compound, sodium ion and sulfate ion.

39. The charge-controlling agent according to claim 24, wherein the charge-controlling agent comprises di-tert-butylsalicylic acid, di-tert-butylsalicylic acid chromium compound, sodium ion and sulfate ion.

40. The charge-controlling agent according to claim 24, wherein the charge-controlling agent comprises di-tert-butylsalicylic acid, di-tert-butylsalicylic acid zinc compound, sodium ion and sulfate ion.

41. The charge-controlling agent according to claim 24, wherein the charge-controlling agent comprises 5-tert-octylsalicylic acid, 5-tert-octylsalicylic acid aluminum compound, sodium ion and sulfate ion.

42. The charge-controlling agent according to claim 24, having a negative charge-controllability.

43. The charge-controlling agent according to claim 24, having a volume resistivity of at most $9.5\times10^8$ ohm.cm.

* * * * *

UNITED STATES PATENT AND TRADEMARK OFFICE

CERTIFICATE OF CORRECTION

PATENT NO. : 5,700,617

DATED : December 23, 1997

INVENTOR(S) : TAKIGUCHI ET AL.

It is certified that error appears in the above-identified patent and that said Letters Patent is hereby corrected as shown below:

COLUMN 5

Line 62, "oxycarbolxylic" should read --oxycarboxylic--.

COLUMN 6

Line 30, "fewer" should read --smaller--;
Line 51, "$C \geqq 10^2$" should read --$C \geqq 10^2$,--;
Line 62, "found" should read --found that--;
Line 64, "affect" should read --affects--.

COLUMN 7

Line 52, "acrylresin" should be deleted.
Line 55, "chmarone-indene" should read --cumarone-indene--;
Line 64, "derivative" should read --derivatives--.

COLUMN 8

Line 39, "provide" should read --providing--

COLUMN 10

Line 21, "include;" should read --include:--;
Line 24, "181:" should read --181;--.

COLUMN 11

Line 15, "or" should read --a--;
Line 41, "capacitor 17" should read --capacitor 16--.

COLUMN 14

Line 44, "CompositiOn" should read --Composition--.

UNITED STATES PATENT AND TRADEMARK OFFICE

CERTIFICATE OF CORRECTION

PATENT NO. : 5,700,617

DATED : December 23, 1997

INVENTOR(S) : TAKIGUCHI ET AL.

It is certified that error appears in the above-identified patent and that said Letters Patent is hereby corrected as shown below:

COLUMN 19

Line 15, "level" should read --levels--;
Line 34, "carboxylic" should read --oxycarboxylic--;
Line 35, "A (wt" should read --A (wt.%),--.

COLUMN 21

Line 6, "carboxylic" should read --oxycarboxylic--;
Line 7, "A (wt." should read --A (wt.%),--;
Line 17, "satisfying" should read --satisfy--;
Line 23, "satisfying" should read --satisfy--;
Line 44, "satisfying" should read --satisfy--;
Line 54, "satisfying" should read --satisfy--.

Signed and Sealed this

Fourteenth Day of July, 1998

Bruce Lehman

*Attest:*

BRUCE LEHMAN

*Attesting Officer*

*Commissioner of Patents and Trademarks*